US005236193A

United States Patent [19]

Ierulli

[11] Patent Number: 5,236,193

[45] Date of Patent: Aug. 17, 1993

[54] BLACK HOLE BOARD GAME

[76] Inventor: Anthony F. Ierulli, 3555 29th St. #1C, Long Island City, N.Y. 11106

[21] Appl. No.: 982,568

[22] Filed: Nov. 27, 1992

[51] Int. Cl.[5] ..... A63F 3/00

[52] U.S. Cl. ..... 273/252; 273/250; D21/32; D21/33

[58] Field of Search ..... 273/248-254, 273/258, 264, 271; D21/32, 33, 34

[56] References Cited

U.S. PATENT DOCUMENTS

| | | | |
|---|---|---|---|
| 977,485 | 12/1910 | Tercy | 273/261 |
| 1,692,519 | 11/1928 | Spilling | 273/248 |
| 2,194,854 | 3/1940 | Howard | 273/248 |
| 2,239,449 | 4/1941 | Senz | 273/264 |
| 5,037,109 | 8/1991 | Bowen | 273/253 |

FOREIGN PATENT DOCUMENTS

| | | | |
|---|---|---|---|
| 139849 | 5/1930 | Switzerland | 273/261 |
| 1075266 | 7/1967 | United Kingdom | 273/258 |
| 2136697 | 9/1984 | United Kingdom | 273/253 |

*Primary Examiner*—Benjamin H. Layno

[57] ABSTRACT

A game apparatus where one to three players race their space ships from their respective bases to their respective outposts via a radial graph. Players choose one of two modes of travel (conventional space travel or the wormhole space travel system) at each turn in order to best reach their respective goals. For conventional space travel, the difference in the numbers showing after the roll of the dice provide positive numbers which enable a player to move their ships in any desired direction within a radial graph, or negative numbers which require a player to move their ships inward, towards and into the black hole and back to base. Wormhole travel enables a player to instantaneously move a ship from any one of six positions on the graph to one of those same six spots. The first player to get all of their ships in their outpost wins.

9 Claims, 4 Drawing Sheets

BLACK HOLE BOARD GAME

BACKGROUND OF THE INVENTION

1. Field of the Invention

The present invention relates generally to a game device and more specifically, this invention relates to board games of chance and skill where, in racing from a starting point to a finish, movement is not limited to a linear path around the board and where negative numbers as well as positive numbers are utilized to direct the course of the game.

2. Description of Related Art

Various types of game boards, such as Parcheesi, Sorry and Trouble have been provided which accommodate racing from a starting point to a finish and which utilize dice or other chance devices to direct the course of the game. There are many game boards such as Chess and Chinese Checkers which offer players a choice of paths not limited to a linear path around the board. Board games with concentric and radial designs providing multiple paths have also been provided in the past, the patents of which are cited here: 4,971,332, 4,895,375, 4,208,054, 4,030,762, 3,223,420, 2,990,181. While the above cited references have advantages and merit, none of these board games employs the same radial graph design used in this invention which enables players to race from start to finish in a graph traversal problem of multiple paths. None of the previously cited games use negative rolls of the dice provided by taking the difference of the numbers showing on the dice to draw a player's pieces to the center of the board, sending them back to their starting position. However, the game board of U.S. Pat. No. 2,990,181 suggests the use of radial paths emanating from the "sun" at the center of the board to represent the gravitational pull of the sun as a hazard, but fails to give any details as to how said hazard would be implemented. The game boards of U.S. Pat. Nos. 4,208,054, 4,895,375 and 4,971,332 use the space at the center of the board as the goal of the game but not as a hazardous, attractive force. The game boards of U.S. Pat. Nos. 3,223,420 and 4,030,762 both have means of instantaneous travel where by chance, when a player lands on a given player piece position, that piece is either sent to the center of the board as is the case in the game of U.S. Pat. No. 4,030,762, or as is the case in the game of U.S. Pat. No. 3,223,420, instructions on a card may send a player's piece to a stated position. Neither of these games offers a player the option of using their respective instantaneous travel systems.

SUMMARY OF THE INVENTION

An object of this invention is to provide a game in which 1 to 3 players can race their 5 game pieces, which represent space ships, across the board throughout a radial graph providing multiple paths from their designated bases to their designated outposts where the difference between the numbers showing after a roll of the dice (one die represents positive numbers, the other represents negative numbers) determines the total number of moves a player can divide among his ships.

Another object of the invention is to provide a hazard to be avoided in the form of a black space at the center of the radial graph which represents a "black hole" that makes itself felt with the roll of a negative number that forces a player's ships inward, toward the center of the radial graph, into the black hole and back to the player's base.

A further objective of this invention is to provide a player the means of transporting, with the roll of a single die, instantaneously from one of six designated points in the graph to any of the same six designated points in the graph to escape the danger of the black hole or to take a chance at moving instantly to that player's outpost.

Another object of this game is to provide an educational game teaching about subtraction, odds, chance, graph traversal, and the celestial phenomena, black holes and wormholes.

Still another goal of this invention is to provide an exciting and challenging game of chance and skill where a set of simple, basic, easy to learn steps can be built up into varied and complex strategies in a game that is constantly changing with each roll of the dice.

DETAILED DESCRIPTION

Figure 1:
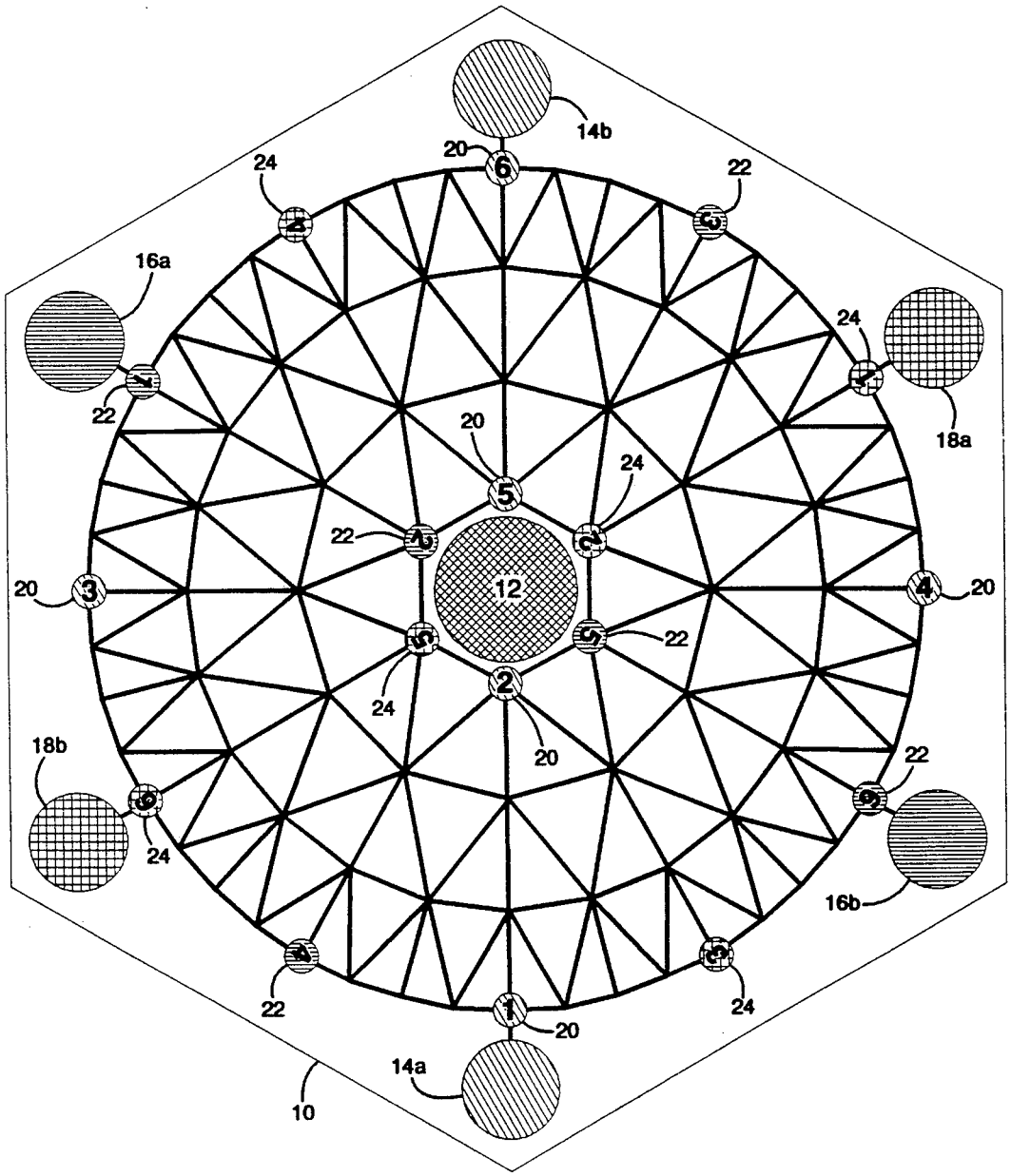
FIG. 1 is a plan view of the game board of the present invention.
Figure 2:
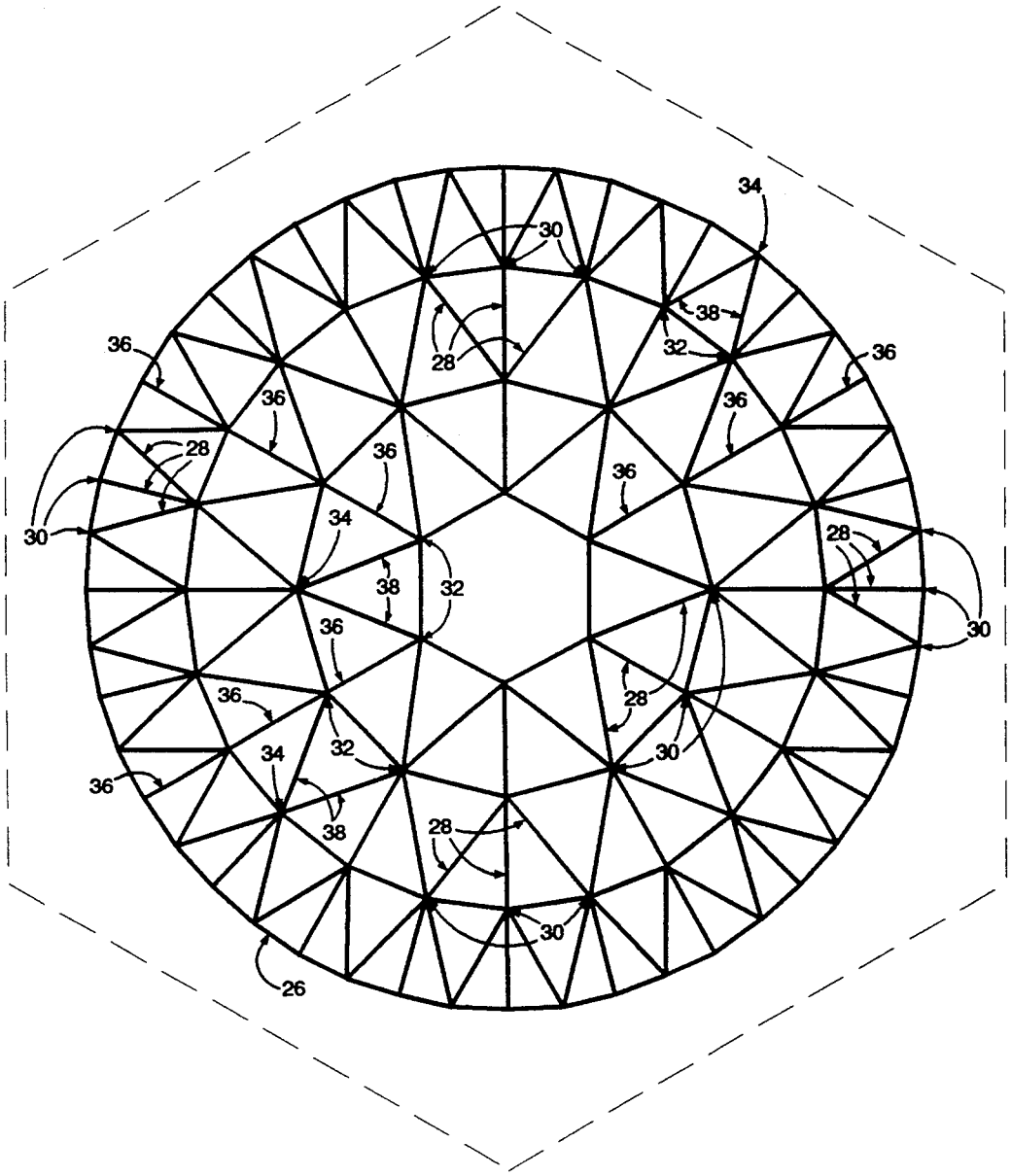
FIG. 2 is a plan view of the graph utilized in the game board of the present invention.
Figure 3:
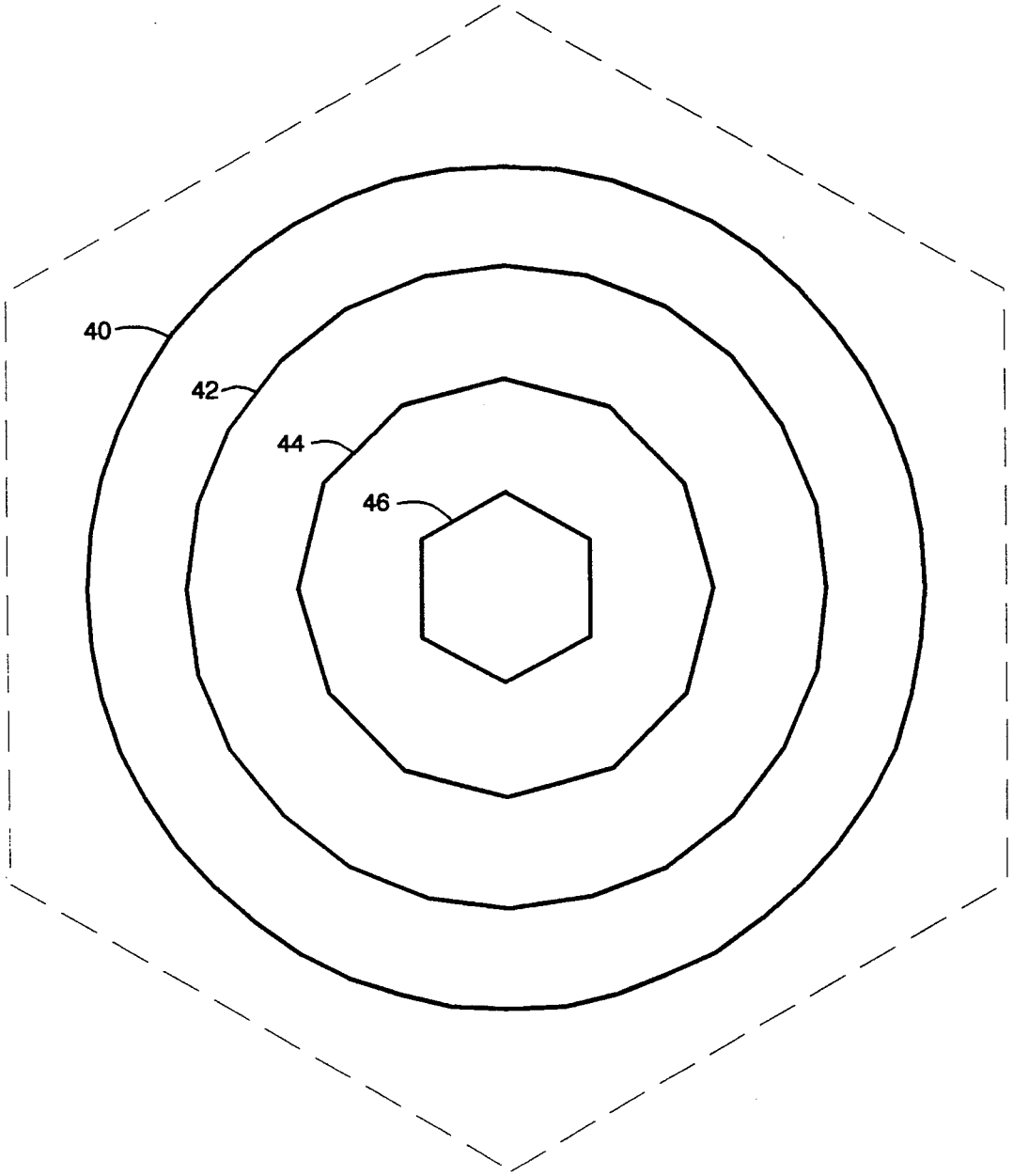
FIG. 3 is a plan view of the four concentric polygons that make up part of the graph utilized in the game board of the present invention.
Figure 4:
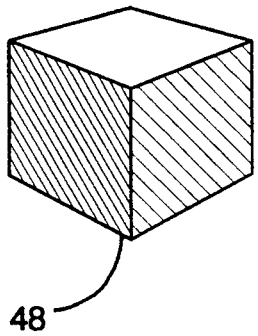
FIG. 4 is a perspective view illustrating representative game pieces.
Figure 5:
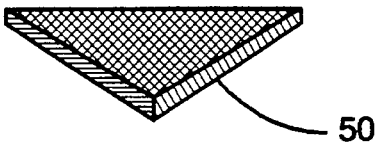
FIG. 5 is a perspective view illustrating one conventional white die and one conventional black die.
Figure 6:
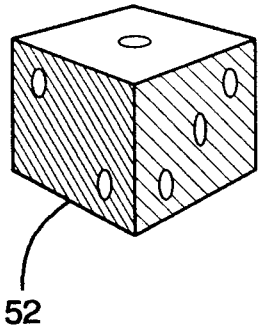
Figure 7:
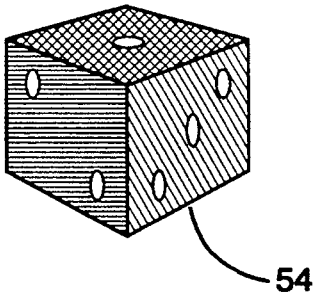

The "Black Hole (Board Game)" consists of a game board generally designated by reference number 10, 15 playing pieces 48, 15 tokens 50, and 2 standard 6-Sided dice 52 and 54.

Playing pieces 48 will be any identical 3-dimensional object representing a space ship and which will be one of three colors with five of said playing pieces of each color.

Each of the 15 tokens 50 will be any generally flat geometric object distinguishable from the playing pieces 48 and will be any color, preferably black, and being a different color than any of the three colors of the playing pieces 48.

The dice 52 and 54 will be standard dice, one black and one white, where the white die represents positive numbers and the black die represents negative numbers.

The hexagonal shaped game board 10 may be constructed of materials such as paperboard, cardboard or other standard material used in the construction of game boards. The planar upper surface of said game board will have certain indicia printed on the board itself or printed on a piece of paper which will be glued or laminated onto the game board.

The game board 10 is comprised of a "black hole", which is a shaded circular black area at the center of the board, designated by reference number 12, a graph 26, three base/outpost pairs 14, 16 and 18 and three wormhole systems 20, 22 and 24.

The graph 26 is made up of four concentric equilateral polygons 40, 42, 44 and 46 where the vertices within each polygon are equidistant from the center of the board and where the radius of each polygon differs from each other and where the number of sides per polygon, moving outward from the inner polygon 46, are 6, 12, 24, and 48 respectively. Each vertex of an inward polygon 42, 44 or 46 has three edges generally designated by reference number 28 connecting it to the next outward polygon 46, 42 or 44 such that no edge crosses another. Each of these three edges 28 connects to one of 3 adjacent vertices generally designated by reference number 30 on the next outward polygon 40, 42 or 44. Two edges, generally designated by reference number 38, each from any two adjacent vertices generally designated by reference number 32 on an inward polygon 42, 44 or 46, connect to a common vertex generally designated by reference number 34 on the next outward polygon 40, 42 or 44.

Each base/outpost pair 14, 16, and 18 is a pair of identical geometric shapes, where each pair is colored to match one of the three colors of the playing pieces 48. The base and outpost of each pair are positioned, diagonally opposed to each other, outside the outer polygon 40 and adjacent, but not necessarily connected by an edge, to diagonally opposing vertices located on said outer polygon. The opposing vertices On the outer polygon 40 marking the position of any base/outpost pair 14, 16, or 18 are determined by moving outward three times from diagonally opposing vertices on the inner hexagon 46, repeatedly taking the center edge generally designated by reference number 36 of the three edges 28 connecting a vertex to the next outward polygon 40, 42 or 44 until the two opposing vertices on the outer polygon 40 are reached. The base 14*a*, 16*a* or 18*a* or outpost 14*b*, 16*b* or 18*b* in any base/outpost pair 14, 16 and 18 is angled 120 degrees around Center of the board 10 from the base or outpost in each of the other said base/outpost pairs respectively.

Each base/outpost pair 14, 16 and 18 has a wormhole system 20, 22, and 24 respectively associated with it where each of said wormhole systems has a set of six circles (wormhole openings) that are the same color as said base/outpost pairs associated with them and which are numbered from 1 to 6 with the numbers oriented in the center of said circles such that the vertical axis of each number is parallel to the line defined by the base-/outpost pair of the same color and where the bottom of said numbers is in the direction of the base 14*a*, 16*a* or 18*a* of the same color. The wormhole openings for the three wormhole systems 20, 22 or 24 are positioned on 18 different vertices in the graph 26. The wormhole opening 20, 22 or 24 (of any given wormhole system) labeled with a 1 is positioned on the vertex on the outer polygon 40 which is adjacent to the base 14*a*, 16*a* or 18*a* of the same color. The wormhole opening 20, 22 or 24 (of any given wormhole system) labeled with a 2 is positioned on the vertex on the inner hexagon 46 which is exactly three steps inward toward the center of the graph 26 from the wormhole opening 20, 22 or 24 of the same color labeled with a 1. The wormhole opening 20, 22 or 24 (of any given wormhole system) labeled with a 3 is positioned on the vertex located on the outer polygon 40 ¼ of the distance (12 vertices) around said polygon from the wormhole opening 20, 22 or 24 of the same color labeled with a 1, moving in a clockwise direction around said polygon. The wormhole opening 20, 22 or 24 (of any given wormhole system) labeled with a 4 is positioned on the vertex located on the outer polygon 40 1/4 of the distance (12 vertices) around said polygon from the wormhole opening 20, 22 or 24 of the same color labeled with a 1, moving in a counter clockwise direction around said polygon. The wormhole opening 20, 22 Or 24 (of any given wormhole system) labeled with a 5 is positioned on the vertex on the inner hexagon 46 diagonally opposite the wormhole opening 20, 22 or 24 of the same color labeled with a 2. The wormhole opening 20, 22 or 24 (of any given wormhole system) labeled with a 6 is positioned on the vertex on the outer polygon 40 which is adjacent to the outpost 14*b*, 16*b* or 18*b* of the same color.

THE RULES OF THE GAME ARE AS FOLLOWS

The object of the game is for a player to be the first to get all of his ships 48 from his base 14*a*, 16*a* or 18*a* to his outpost 14*b*, 16*b* or 18*b*. At the beginning of the game each player starts with 5 ships 48 of a given color positioned on the base 14*a*, 16*a* or 18*a* of the same color along with 5 wormhole tokens 50. After deciding who goes first, players take turns in clockwise order around the board 10.

There are two modes of travel a player may choose from at each turn; the conventional space travel system where players move their ships 48 throughout graph 26 or the wormhole space travel system which is made up of tokens 50 and the wormhole systems 20, 22, or 24.

Conventional space travel enables a player to move from vertex to vertex throughout the graph 26 by rolling both dice 52 and 54 to determine the total number of moves (positive moves for a positive roll or negative moves for a negative roll) available for the current turn. A positive roll is when the value showing on the positive (white) die 52 is greater than the value showing on the negative (black) die 54. A negative roll is when the value showing on the negative (black) die 54 is greater than the value showing on the positive (white) die 52. The difference between the numbers showing on the dice determines the total number of moves which can be divided among the player's ships 48 in any combination of valid positive moves for a positive roll or valid negative moves for a negative roll. Valid positive moves include: LAUNCHING a ship from a player's base 14*a*, 16*a* or 18*a* to the unoccupied vertex in the graph 26 adjacent to said base and marked by the wormhole opening 20, 22 or 24 of the same color labeled with the number 1; MOVING in any direction from one vertex in the graph 26 to any adjacent unoccupied vertex in said graph along the edge connecting the two vertices or; DOCKING a ship from the vertex in the graph 26 which is adjacent to the players outpost 14*b*, 16*b* or 18*b* and which is marked by the wormhole opening 20, 22 or 24 of the same color labeled with the number 6, into said outpost. Valid negative moves include: MOVING INWARD, from an outward polygon 40, 42 or 44 to the next inward polygon 42, 44 or 46, toward the "black hole" 12 at the center of the graph 26 from one vertex in said graph to an adjacent unoccupied vertex in said graph along the edge (either edge when there are 2 options) connecting the two vertices, or MOVING INTO the black hole 12 and back to the player's base 14*a*, 16*a* or 18*a* from any of the vertices marked by a wormhole opening 20, 22 or 24 of any Color labeled with either a 2 or a 5 on the inner hexagon 46 surrounding the black hole 12. When a double roll occurs, the player receives one wormhole token 50 up to, but not exceeding, five tokens in hand. If a valid move cannot be made, the next player takes a turn.

A player may choose to move one of their ships 48 through the wormhole system 20, 22, or 24 of their color if that player has one or more ships 48 positioned on any of said wormhole openings and they have a wormhole token 50 to use. After paying the toll with one token 50, the player rolls one of either die 52 or 54 to determine where the ship 48 of their choice will exit their wormhole system 20, 22, or 24 The player's ship 48 is moved to the wormhole opening 20, 22, Or 24 of their color which displays the same number that is shown on the die, 52 or 54, rolled. If any ship 48 occupies that position there is no move and the next player takes a turn.

The game ends when the first person gets all of their ships 48 docked in their outpost 14*b*, 16*b* or 18*b*.

Various changes in the design and operation of this game are anticipated and to be expected. The use of the "black hole" as the preferred embodiment of the hazardous, attractive force at the center of the board is in no way exclusive as similar attractive forces such as whirlpools, vacuums or even magnets can also be represented.

Variations on the rules governing play such as losing ones ships permanently into the black hole and having the winner be the first to get a single ship into an outpost or having a means of knocking out or removing an opponent's pieces are possible. The number of pieces used in the game such as the number of ships, tokens, or dice can vary as can the visual design of the board, game pieces or the packaging itself.

Visual design can range from the purely abstract, where three dimensional geometric designs are used for playing pieces and two dimensional designs are used to represent the different elements of the board, to the specific where exact replicas of space ships, real or fictional, are used as playing pieces and where photographs of the stars are used as a backdrop to a playing field where literal depictions of space stations are used as bases and outposts and where educational text teaching about "black holes" and "wormholes" can be printed on the board or packaging.

Variations in the materials used in board construction are possible as well, where, besides the use of the standard cardboard and paper, the use of metal or wood is possible allowing for recesses in the board surface at player piece positions in order to accommodate marbles as playing pieces.

Along with the various options of implementing this game with physical materials is the option of adapting the game to the computer environment with design varying from a simple simulation of the board game as it is, to a game using the concepts of the board game but utilizing a three dimensional computer model to dramatize the flight of ships around a black hole.

The wording in this particular embodiment is used merely as a description of the concepts and principles of this invention and in no way limits the invention to the exact construction and operation as is shown and described. Various changes in design and operation of this game will readily occur and can be made without departing from the spirit or scope of the invention and it is intended that the appended claims cover all such variations and changes.

What is claimed:

1. A board game comprising:

a plurality of movable playing pieces;

a game board with indicia providing for a radial graph defining a plurality of vertices, said vertices of said graph provide multiple playing piece positions and where the edges, straight or curved, of said graph provide multiple paths for said playing pieces and where the center of said graph is concentric to the center of said game board;

a plurality of systems each system comprising a plurality of designated playing piece positions distributed throughout said radial graph, wherein each designated playing piece position of a system having a different mark such that each designated playing piece position correspond to a different outcome on a die providing instantaneous chance movement throughout designated player piece positions in said graph;

a center area disposed in the center of said game board;

a plurality of base/outpost pairs positioned outside said graph such that the base and outpost of each said pair is positioned diagonally opposite each other around the outside of said graph and such that the bases and outposts of all said pairs are equidistant from each other, respectively, around the outside of said graph;

a plurality of player tokens to be used with said systems of instantaneous movement;

a chance means for determining the number of moves throughout said graph which a player can divide among his playing pieces;

a system for drawing said movable playing pieces into said center area;

at least one each of two types of dice, each die having a plurality of faces each face having a different marking corresponding to the markings on said designated playing piece positions, each type of die is distinguishable from the other.

2. The board game of claim 1 wherein:

said graph comprises four non-intersecting subgraphs with 6, 12, 24 and 48 edges (and vertices) where the edges within each subgraph are non-intersecting and said subgraph with 6 edges is enclosed inside said subgraph with 12 edges, said subgraph with 12 edges is enclosed inside said subgraph with 24 edges, and said subgraph with 24 edges is enclosed inside said subgraph with 48 edges;

each vertex of an inward subgraph has three edges connecting it to the next outward subgraph such that no edge connecting an inward subgraph to an outward subgraph crosses another and such that each of said three edges connects to one of 3 adjacent vertices on the next outward subgraph;

two edges, each from any two adjacent vertices on an inward subgraph connect to a common vertex on the next outward subgraph.

3. The board game of claim 1 wherein:

a player has the choice of using at least one of said instantaneous travel systems;

at least one of said tokens is paid by a player to use said instantaneous travel system;

a roll of at least one of said dice determines the destination from said instantaneous travel system.

4. The board game of claim 1 wherein:

said types of distinguishable dice are determined that one type represents positive numbers and the other type represents negative numbers and where the sum of the numbers showing after the roll of at least one of each of the two types of dice produces either a positive number, a negative number or zero;

said chance means for determining the number of moves a player can divide among his playing pieces is provided by said negative and positive numbers determined by the roll of said dice.

5. The board game of claim 4 wherein:

said center area disposed in the center of said game board represents a hazard in the form of an attractive force attracting said movable playing pieces into said center area;

said system for drawing said movable playing pieces into said center area is implemented by using said negative numbers produced by the roll of said dice to force said playing pieces inward towards said center area.

6. A board game comprising:

numerous movable playing pieces;

a game board with indicia for a graph design defining a plurality of vertices, said vertices of said graph provide multiple playing piece positions and where the edges, straight or curved, of said graph provide multiple paths for said playing pieces;

a multitude of systems providing instantaneous chance movement throughout designated player piece positions in said graph;

at least one designated area positioned within said graph;

a multitude of base/outpost pairs positioned outside said graph such that the base and outpost of each said pair is positioned an equal number of vertices from each other around the perimeter of said graph and such that the bases and outposts of all said pairs are an equal number of vertices from each other, respectively, around the perimeter of said graph;

a multitude of player tokens to be used with said systems of instantaneous movement;

a chance means, said chance means having a plurality of different outcomes, each different outcome corresponding to the markings on said designated playing piece positions, said chance means for determining the number of moves throughout said graph which a player can divide among his playing pieces;

a system for forcing said movable playing pieces into said designated area.

7. The board game of claim 6 wherein:

a player has the choice of using at least one of said instantaneous travel systems;

at least one of said tokens is paid by a player to use said instantaneous travel system;

a chance means device determines the destination from said instantaneous travel system.

8. The board game of claim 6 wherein:

said chance means for determining the number of moves a player can divide among his playing pieces is provided by a chance device providing at least two distinguishable types of numbers.

9. The board game of claim 8 wherein:

said designated area disposed within said graph represents a hazard in the form of an attractive force attracting said movable playing pieces into said designated area;

the system for drawing said movable playing pieces into said designated area is implemented by using one type of said two types of numbers determined by said chance means device to force said playing pieces towards said designated area.

* * * * *